United States Patent [19]

McBain

[11] Patent Number: 5,022,291

[45] Date of Patent: Jun. 11, 1991

[54] PLIERS HAVING A PIVOTAL JAW

[76] Inventor: Corey L. McBain, 27 Mt. Herman Rd., Scotts Valley, Calif. 95073

[21] Appl. No.: 563,515

[22] Filed: Aug. 6, 1990

[51] Int. Cl.[5] ..... B25B 7/02

[52] U.S. Cl. ..... 81/424; 81/185.2

[58] Field of Search ..... 81/185.2, 186, 418, 81/421, 424

[56] References Cited

U.S. PATENT DOCUMENTS 1,561,833 11/1925 Cruickshank .

2,679,779 6/1954 Spikings ..... 81/424 X

FOREIGN PATENT DOCUMENTS 316876 12/1956 Switzerland ..... 81/424

154 1/1908 United Kingdom ..... 81/424

*Primary Examiner*—James G. Smith

[57] ABSTRACT

A pliers having at least one pivotable jaw that can reorient itself so that its work-engagement surface is parallel to the flat on the associated nut or bolt. The jaw surfaces meet the faces of the nut or bolt evenly, no matter what the bolt or nut size (within limits).

3 Claims, 1 Drawing Sheet

PLIERS HAVING A PIVOTAL JAW

BACKGROUND AND SUMMARY OF THE INVENTION

This invention relates to a pliers adapted to have firm gripping engagement with a range of different size nuts and bolts.

A conventional pliers includes two pivotably connected handle members having opposed facing jaws adapted to grip a nut or bolt therebetween. The jaw surfaces enjoy firm gripping contact with the nut or bolt only when the jaw surfaces are parallel. For a given pivotal connection of the two handle members the desired parallelism is only possible for one particular size nut or bolt; for other nut or bolt sizes the jaw surfaces are acutely angled to one another so that they do not have firm flatwise contact with the flats on the nut or bolt. As a result, the pliers tend to slip on the nut or bolt when a turning torque is applied to the handle portions of the pliers.

U.S. Pat. No. 1,561,833 to A. Cruickshank shows a pliers having one of its jaws constructed as an adjustable jaw element pivotably attached to one of the pliers handle members. The pivotal nature of the jaw element enables the work-engagement surface of the jaw element to be parallel with the opposed work-engagement surface of the other jaw element when the jaw elements have various different spacings. The pliers can therefore maintain a firm flatwise gripping engagement with a range of different sized nuts or bolts.

The pivotal jaw element in U.S. Pat. No. 1,561,833 is disclosed as having a loose pivotable fit in the associated handle member in order that stresses associated with the gripment process will be transmitted onto an enlarged bearing surface concentric with the pivot pin. In service, the pivotable jaw would tend to swing or flip-flop in a relatively uncontrolled manner while the pliers was being removed from one set of flats on the work and transferred to another set of flats. It is believed that this would be disconcerting to the user. Also, it might make it somewhat more difficult to place the pivotal jaw against the flat on the work.

The present invention contemplates a pliers somewhat similar to the pliers shown in U.S. Pat. No. 1,561,833, but without the loose pivotal swinging motion associated with the patented arrangement. In the proposed pliers the pivotal jaw has a relatively large diameter semi-circular bearing surface engaged with a mating concave bearing surface on the pliers arm structure. A small diameter circular pin extends through a slot in the pivotal jaw to swingably retain the jaw on the arm structure. The pin has a close sliding fit on the slot walls, such that the bearing surfaces are frictionally maintained in any given position in the absence of an applied force. The jaw can pivot, but without the uncontrolled flip-flop action that is apparently produced with the earlier patented arrangement.

THE DRAWINGS

DESCRIPTION OF A PREFERRED EMBODIMENT OF THE INVENTION

Figure 1:
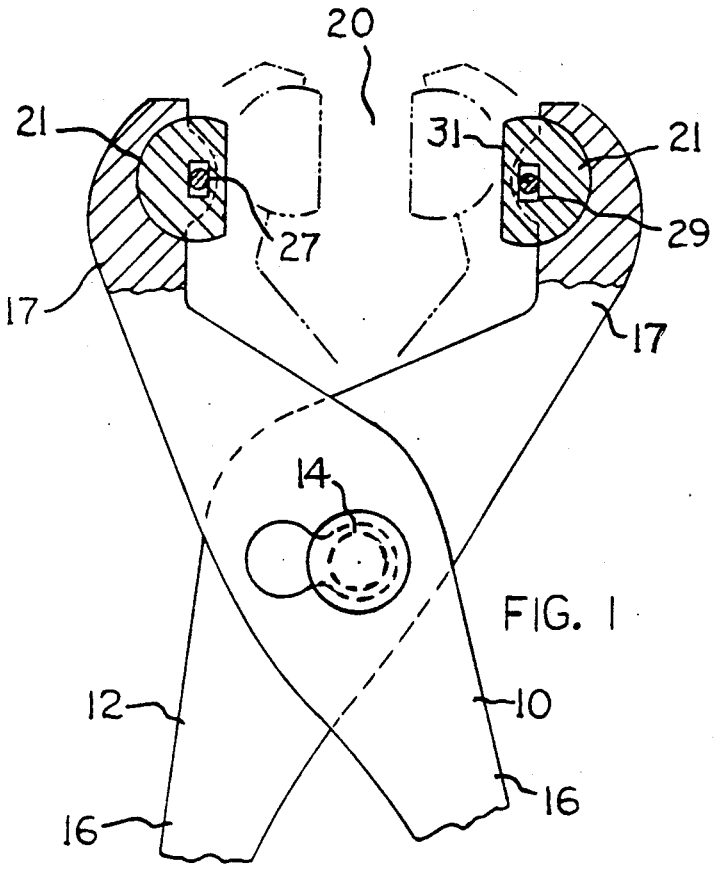
FIG. 1 shows a pliers embodying the invention.
Figure 2:
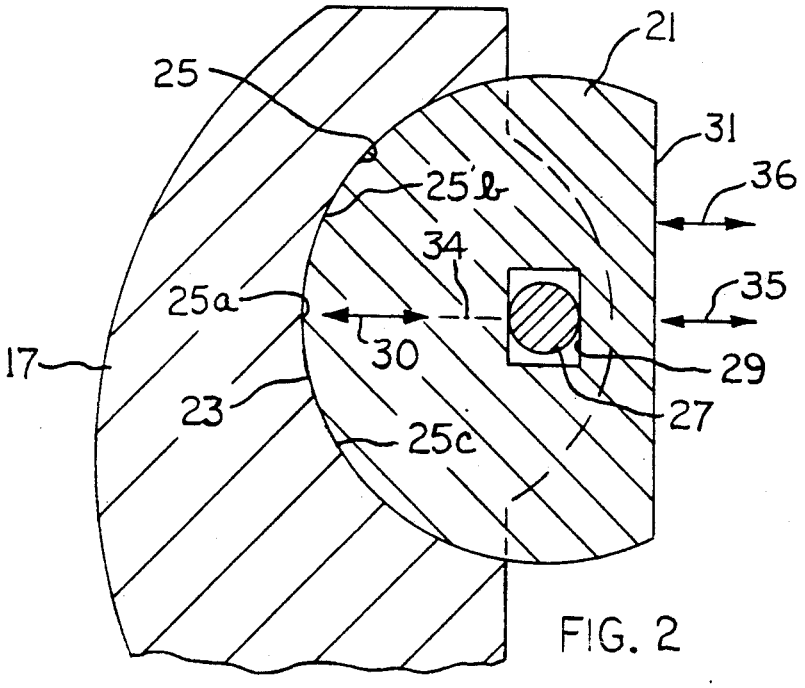
FIG. 2 is a fragmentary enlarged sectional view of a structural arrangement used in the FIG. 1 pliers.

The drawings show a pliers that includes two elongated crossing handle members 10 and 12 having a pivotal connection 14 at an intermediate point along each member. Areas 16 of the handle members below pivot connection 14 serve as hand-engageable actuators for operating the pliers. Areas 17 of the handle members above pivot connection 14 serve as work-encircling arm structures. The work (not shown) is located in space 20 between the two arm structures. In FIG. 1 the arm structures 17 are shown in two positions, i.e. relatively far apart as seen in full lines, and relatively close together, as seen in dashed lines.

Each arm structure 17 carries a jaw structure 21. Each jaw structure has a relatively large diameter convex circular seating surface 23 thereon. The associated arm structure has a mating concave circular seating surface 25. Surface 25 can be formed by milling a cavity in the arm structure; the jaw structure fits into the milled cavity. Alternately, the cavity could be formed by attaching end plates to the arm structure.

A circular pin 27 extends transversely through a slot 29 formed in each jaw structure 21; opposite ends of the pin are anchored firmly in holes formed in arm structure 17. The pin has its axis located on the center point of the associated concave circular seating surface 25, such that jaw structure 21 can rotate around the pin axis without interference from the pin.

The diameter of pin 27 is the same as the minor width dimension of slot 29. Therefore jaw structure surface 23 is maintained against arm structure surface 25 without play in the arrow 30 direction. Slot 29 is oriented on (in) jaw structure 21 so that surfaces 23 and 25 are in close sliding frictional engagement, whereby the jaw structure is maintained in a given position in the absence of any force applied to work-engagement surface 31.

When the two opposed work-engagement surfaces 31 of jaw structures 21 close against the flats on a nut or bolt the jaw structures will pivot around the axes of the associated pins 27, thereby maintaining the work-engagement surfaces 31 in parallelism with the flats and with each other, as shown in FIG. 1.

If the jaws should be oriented on the nut or bolt so that the jaw centerlines 34 coincide with the nut or bolt axis then the load forces and reaction forces will coincide with the jaw centerlines, as indicated by arrows 35. Seating surface 25 will absorb the forces essentially on central areas **25*a*** of the surface.

In many cases the jaw centerlines 34 will not coincide with the nut or bolt axis. In such cases the resultant load forces will be offset from jaw centerlines 34; arrows 36 illustrate one instance of the offset loading condition. Load forces are applied to area **25*b* of surface 25. However slot 29 allows jaw structure 21 to shift slightly in a downward direction such that some of the load is applied to area 25*c* of surface 25. Ultimately the load is shared by surfaces 25*b* and 25*c*; slot 29 acts as a load distribution device, such that the pliers have a firmer grip on the work, with less tendency to slip off the work. The downward shift of jaw structure 21 on arm structure 17 is very slight and imperceptible to the naked eye. The shift is only a slight reaction to the load forces, as will transfer some of the load from surface area 25*b* onto surface area 25*c*. Gripping action of the jaws on the work is improved when surface 23 and 25 are in firm frictional contract; slot 29 promotes such contact when the load forces are offset, as at 36**.

The jaws are preferably designed so that each seating surface 23 has a diameter that is at least four times the diameter of the associated pin 27. Pin 27 acts primarily as a device to maintain surfaces 23 and 25 in frictional engagement, without play in the arrow 30 direction. The drawings show both jaws of the pliers as pivotable. However, it would be possible to practice the invention with only one pivotable jaw.

I claim:

1. A pliers comprising two elongated crossing handle members pivotally connected at intermediate points along their length dimensions to form two opposed work-encircling arm structures and two opposed hand-engageable actuators; a jaw structure carried on each work-encircling arm structure; at least one of said jaw structures being pivotably connected to the associated arm structure; said one jaw structure having a relatively large diameter convex circular seating surface thereon; the arm structure associated with said one jaw structure having a relatively large diameter concave circular seating surface slidably engaged with the circular seating surface on said one jaw structure; each jaw structure having a work-engagement surface; the work-engagement surface on said one jaw structure being formed as a straight chord surface relative to said concave circular seating surface; an elongated parallel-walled slot extending through said one jaw structure parallel to the associated work-engagement surface; a circular pivot pin extending transversely through said slot, said circular pin having its opposite ends anchored to the associated arm structure; said circular pin having its axis located on the center point of the associated concave circular seating surface; the diameter of said circular pin being the same as the minor width dimension of the associated slot, whereby said one jaw structure is prevented from shifting on the pin in a direction transverse to the longitudinal axis of the slot; the diameters of the two large diameter circular seating surfaces being the same; the circular pin being oriented so that the two circular seating surfaces are in close sliding frictional engagement, wherein said one jaw structure maintains a given position in the absence of any force applied to its work-engagement surface.

2. The pliers of claim 1, wherein the diameter of the circular convex seating surface is at least four times the diameter of the circular pin.

3. The pliers of claim 2, wherein each jaw structure is pivotably connected to its associated arm structure; each jaw structure having the same configuration; each arm structure having a circular pivot pin extending transversely through a parallel-walled slot in the associated jaw structure.

* * * * *